US006352010B1

(12) United States Patent
Giarritta et al.

(10) Patent No.: US 6,352,010 B1
(45) Date of Patent: Mar. 5, 2002

(54) MULTIPLE PURPOSE TOOL

(76) Inventors: Franco Giarritta, Baumgartenstrasse 17, Rickenbach (CH), 6432; Carl Elsener, Rainweg 14, Ibach-Schwyz (CH), 6438

( * ) Notice: Subject to any disclaimer, the term of this patent is extended or adjusted under 35 U.S.C. 154(b) by 0 days.

(21) Appl. No.: 09/435,753

(22) Filed: Nov. 8, 1999

(30) Foreign Application Priority Data

Nov. 9, 1998 (EP) ..... 98121315

(51) Int. Cl.[7] ..... B25B 23/16
(52) U.S. Cl. ..... 81/177.4; 81/439; 7/168
(58) Field of Search ..... 81/437–440, 177.4, 81/124.4; 7/118, 165, 168; 30/161, 164

(56) References Cited

U.S. PATENT DOCUMENTS

| | | | | | |
|---|---|---|---|---|---|
| 1,341,153 | A | * | 5/1920 | Parker et al. | 30/161 |
| 1,783,346 | A | | 12/1930 | Scully | |
| 2,878,701 | A | * | 3/1959 | Weersma | |
| 2,980,996 | A | * | 4/1961 | Beran | |
| 3,877,327 | A | | 4/1975 | Erm | 81/121 |
| 5,060,379 | A | * | 10/1991 | Neely | 30/160 |
| 5,251,353 | A | | 10/1993 | Lin | 7/128 |
| 5,421,225 | A | | 6/1995 | Chen | 81/490 |
| 5,450,775 | A | | 9/1995 | Kozak | 81/440 |
| 5,647,129 | A | * | 7/1997 | Stamper | 30/161 |
| 5,711,194 | A | | 1/1998 | Anderson et al. | 81/440 |
| 5,735,005 | A | | 4/1998 | Wang | 7/127 |
| 5,802,936 | A | | 9/1998 | Liu | 81/450 |
| 5,904,080 | A | | 5/1999 | Anderson et al. | 81/439 |
| 6,014,786 | A | | 1/2000 | Cachot | 7/118 |
| 6,023,805 | A | | 2/2000 | Lin | 7/128 |

FOREIGN PATENT DOCUMENTS

| | | |
|---|---|---|
| DE | 92 14 609.0 | 2/1993 |
| EP | 0 513 937 A2 | 11/1992 |
| EP | 0 776 737 A1 | 6/1997 |
| EP | 0 931 628 A1 | 7/1999 |

* cited by examiner

*Primary Examiner*—D. S. Meislin
(74) *Attorney, Agent, or Firm*—Pennie & Edmonds LLP

(57) ABSTRACT

This invention relates to a multi-purpose pocket tool which may incorporate for instance one or two knife blades, a Philips screwdriver, a pair of pliers, scissors, a cap remover, a can opener, tweezers and the like and, according to this invention, a bit holder shaft and a bit cartridge for single- or double-ended bits suitable for use on electrical devices and especially computers. The tool according to this invention is small in size and weight, easy to handle, and extremely versatile.

26 Claims, 2 Drawing Sheets

A
B
C
1
2
3
4
5
6
7
8
9
10
11
12
13
14
15
16
17

MULTIPLE PURPOSE TOOL

BACKGROUND OF THE INVENTION

1 Field of the Invention

This invention relates to a pocket tool composed of an oblong tool body serving as the handle and incorporating a storage compartment for operational elements which can be extended from the handle into their operating position.

2. Discussion of the Related Art

Comparable pocket tools are known in the art. For instance, they are extant in the form of pocket knives consisting of two mutually facing handle half-shells between which one or several operational elements such as knife blades, corkscrews, screwdrivers and other tools are positioned in extendable fashion, essentially held in the extended or retracted position by the action of a spring. Utensils of that nature have been on the market in the most diverse forms and designs. In most cases, the operational elements such as knife blades, can openers, nail files corkscrews and the like are swivel-mounted on rivets to tilt in and out. There are also pocket knives which additionally include operational elements in the form of various tools, for instance different sizes of flat-blade and Philips screwdrivers or hex-head spanners and socket wrenches. These operational elements are sandwiched between parallel jackplates which are connected via rivets and of which the two outermost plates are covered with handle half-shells. These half-shells serve to give the utensil the appearance of a pocket knife while providing an ergonomic feel and a good grip. Some designs also include channels in the outer shell in which such items as toothpicks, tweezers or cleaning pins for windshield washer jets can be inserted.

Equipping pocket knives with operational accessories for the most diverse purposes even goes as far as combining a traditional jackknife with a writing pen. Pocket knives of that kind involve complex assembly which is reflected in high manufacturing costs.

Conventional pocket tools and in particular jackknives typically feature laterally extendable operational elements which partly protrude from the side of the housing and, traditionally, can be grasped with the fingertips. They tilt against the pressure of a spring which holds them in place both in the retracted carrying or storage position and in the extended operating position. This locking function, provided by the spring action of the resilient components, is not controllable. It can therefore happen that during their use the operational elements snap shut accidentally. Also, over time, the springs are subject to fatigue which is in itself an undesirable phenomenon. Another drawback of tiltable operational elements lies in the fact that they typically swivel around one axis so that they can absorb only limited torsional forces. Some other operational elements are removably plugged into slots in the outer shells or in the tool body proper. Typically, pocket utensils are designed for various universal functions and rarely for specific single-purpose applications since that would not be cost-effective. Most notably, there are no pocket tools with interchangeable operational elements employable for multiple functions in the realm of electrical devices, especially for computer equipment.

SUMMARY OF THE INVENTION

In view of such prior art, this invention is aimed at providing a pocket tool generically along the line mentioned above but equipped with various operational elements employable for different purposes in electrical equipment engineering and especially in the field of computer technology, a tool which is inexpensive to manufacture and easy to use.

In particular, this is to be a tool the operational elements of which are capable of absorbing at least the usual measure of leverage and torsional forces. It is also intended to permit improved control of the positional retention forces in both the carrying and especially the operational positions.

To that effect, the technical solution lies in an enhanced pocket tool concept whereby the body unit is designed both for mounting and for storing tool bits.

A bit holder, preferably pivotable, includes a shaft one end of which is designed to accept a bit while the other end is the swivel-mounting section. That swivel-mounting section is preferably offset relative to the central longitudinal axis of the shaft. This angled design offers a number of advantages. For one, lateral tilting of the shaft into the tool body leaves room for a storage compartment. For another, in the extended position of the bit holder shaft its central longitudinal axis is offset from and extends parallel to the central longitudinal axis of the tool body. That allows for excellent leverage while the flat design of the swivel-mounting section is capable of transferring to the tool body much of the torsional force, i.e., it can absorb a substantial measure of torsional forces. The swivel-mounting section is provided with cams and moves along the guide track of a spring. The spring on its part has detents, so that especially in the tilted-out operating position of the bit holder, the cams in its swivel-mounting section engage the detents. This substantially enhances the positional locking power in both the tilted-in, i.e., retracted, and in the tilted-out operating position. This design approach permits the use even of weak springs. According to the invention, short springs may be used which extend over only part of the length of the tool body. Compared to conventional springs, a length reduction of 30% to 50% is possible. The spring is preferably provided with a spring bolt to increase its strength.

The bit end of the wrench or bit holder features at least two different-sized hexagonal sockets, one axially behind the other. One serves to accept the bits, the other may be used for instance for certain types of nuts, hex-head screws or the like. In computer technology, for one example, D-SUB connectors are used with a particular type of female screws. According to an especially advantageous embodiment of this invention, the bits are double-ended.

The storage compartment in the pocket tool is preferably constituted of cutouts in the panels, meaning the functional jackplates and the intermediate plates. Preferably, a tilt-out bit cartridge is housed in the storage compartment. According to one desirable concept of this invention, the bits are double-ended, i.e., they have working tips at both ends.

The pocket tool is preferably equipped with multiple operational elements such as one or two knife blades, different sizes of flat-head screwdrivers, for instance 1½, 3 and 6 mm wide, perhaps a pair of pliers, a wire cutter, a crimping tool, scissors, a cap remover, a wire stripper, a can opener, tweezers, etc. The bit cartridge is preferably designed to hold up to four single- or double-ended bits most commonly used on electrical appliances, computers, games and the like. Typically they are so-called Posidrive, Torx, Philips, socket and Allen bits. A multi-purpose pocket tool of this type saves space, is light-weight, yet absolutely serves its intended purpose.

Between the spring and the swivel-mounting section of the bit holder shaft, impact or pressure surfaces extend at an oblique angle relative to the axial center line of the pocket tool. These surfaces, sloped at a 20° to 40° angle, permit the use of small or weak springs. In addition, configuring the swivel-mounting section and the guide track of the spring as a paired, matching cam and detent combination causes the corresponding cam to snap into a cam detent or recess when in its end position, producing the necessary locking strength especially in its operational position.

This cam-and-detent combination can also be used for the other operational elements.

Overall, this invention provides a space- and weight-reducing, functionally effective tool set which is particularly useful for working on computer equipment.

Other advantages and features of this invention are outlined in the following description with the aid of the accompanying drawings.

DETAILED DESCRIPTION OF THE INVENTION

Figures 1, 2, 3, 4, 5, 6:
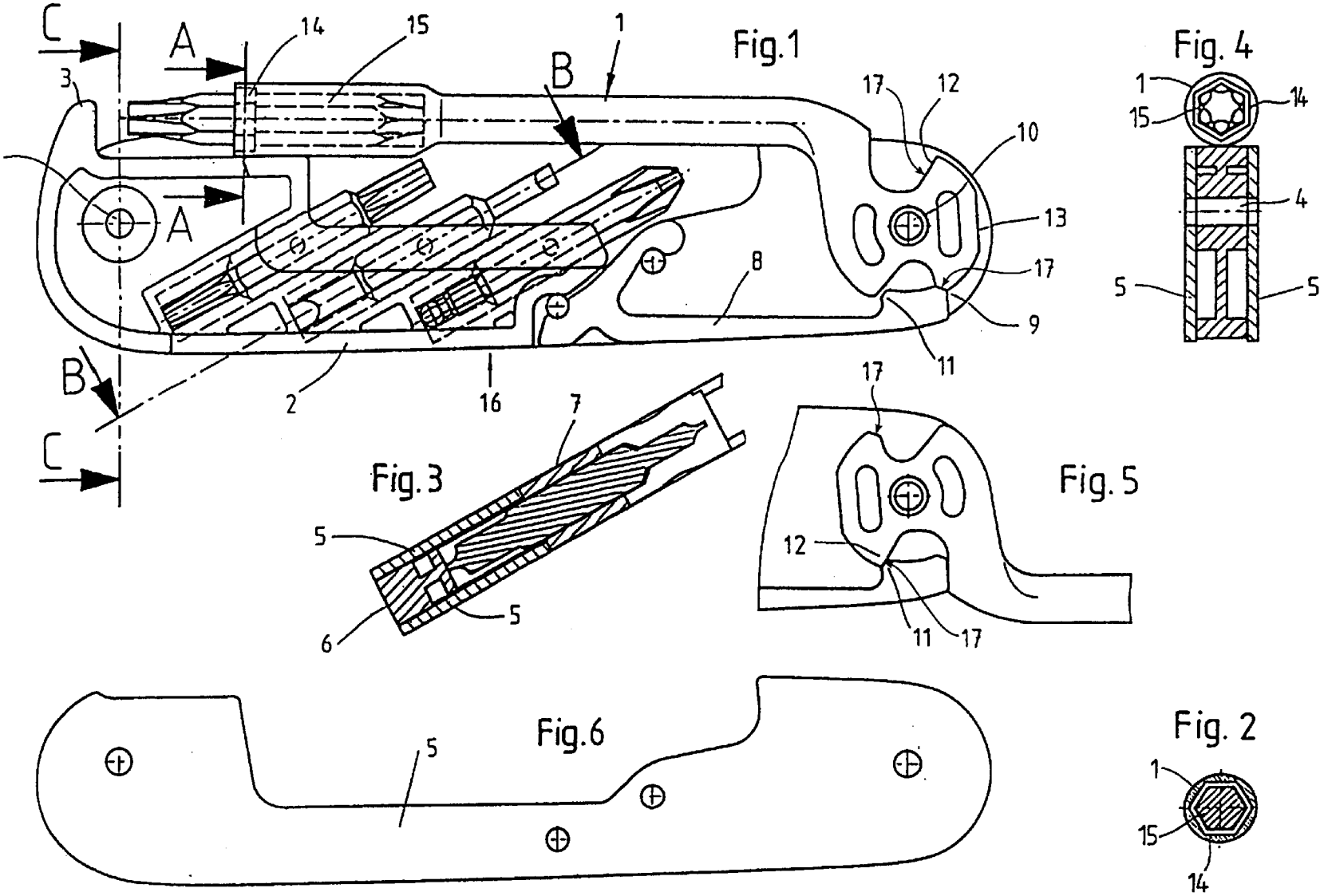
FIG. 1 is an exploded view of part of the pocket tool according to the invention.
FIG. 2 is a sectional view along the line A—A per FIG. 1.
FIG. 3 is a sectional view along the line B—B per FIG. 1.
FIG. 4 is a sectional view along the line C—C per FIG. 1.
FIG. 5 is a detailed illustration of the swivel-mounting section per FIG. 1 with the bit holder shaft in its tilted-out position.
FIG. 6 is a top view of an intermediate plate.

FIG. 1 shows a cross-section of an exemplary multi-purpose pocket tool. Typically, the individual tool chambers are separated by thin intermediate plates, so-called jackplates, which, in conjunction with the half-shells on both sides, also constitute the body of the tool. The design example in FIG. 1 contains a bit holder 1 which, mounted between two jackplates, can swivel around the spindle 10. The bit holder 1 is a shaft-shaped element provided at one end with the actual bit-holding tip in the form of hexagonal sockets 14 and 15 while at its other end, offset relative to the longitudinal center line of the shaft, its swivel-mounting section swivels around the spindle 10. Against the pressure of a spring 8, the bit holder shaft can be tilted out of its position shown in FIG. 1 by 180° into the position shown in FIG. 5. The swivel-mounting section of the bit holder is in the form of a circular segment. Between the spring and the swivel-mounting section of the bit holder shaft, impact and pressure surfaces 17 extend at an oblique angle, relative to the axial center line of the pocket tool when in a folded configuration, and permit the use of small or weak springs. Cut-outs serve to reduce the weight and to form cams for locking functions. The circular segment design gives the bit holder shaft good torsional strength since the torsional forces are distributed over a large area between the jackplates. In the operating position, as shown in FIG. 5, offsetting the spindle 10 relative to the longitudinal axis of the shaft produces a lever effect between the tool body and the axial centerline of the wrench, permitting an excellent power transfer. The circular segment is provided with cut-outs and cams so that, in the position shown in FIG. 1, a swivel-mounting retracted position cam engages a first detent 9 at the locking-spring end. The bit holder shaft is thus firmly locked in its retracted position. To turn the bit holder shaft beyond that point, the swivel-mounting retracted position cam must be disengaged from the first detent 9 against the force of the spring 8. The sloped arrangement of first detent 9 produces a good lever effect relative to the spindle 10. Given the aforementioned matched cam and detent combination, the spring 8 can be a short spring which in the design example illustrated is supported by a bolt so as to enhance the strength of the spring action. As can be seen in FIG. 1, the spring 8 has a second detent 11 which locks the bit holder 1 in the opened, tilted-out position. FIG. 5 shows the bit holder shaft in its tilted-out, extended position, with the stop point 12, serving as a tilted-out position cam, pressing against the second detent 11. This produces increased locking strength in the open (i.e., tilted-out, extended) position of the bit holder, which helps to prevent it from accidentally snapping shut. The short, light-weight spring 8 illustrated is able to apply sufficient locking pressure on the bit holder shaft while in the passive transport position, because first detent 9, angled at 20° measured from the longitudinal axis of the bit holder shaft, pushes against a 22° retracted position cam on the swivel-mounting section. Depending on the desired locking and retaining pressure, these angles can be varied between 15° and 35°. In the open operating position shown in FIG. 5, the bit holder must be held in position with enough strength to prevent it from accidentally snapping back. This may be achieved using angles of about 60° measured from the longitudinal axis of the bit holder shaft on second detent 11 and the cam at stop point 12 of the swivel-mounting section. In practice, this secures the shaft quite adequately, obviating the need for any additional interlocking and release mechanism.

The bit holder shaft incorporates a first hexagonal socket 14 which is about 2 mm deep, as well as a second hexagonal socket 15. In the example shown, the socket 14 is 5.1 mm wide, allowing it to be used for the 5 mm or 3/16" nuts on so-called D-SUB connectors. Plug connectors are in use worldwide in conjunction with computers and other electronic devices. The hexagonal socket 15 is about 16 mm deep and 4.1 mm wide and serves to accept single- and double-ended bits. In FIG. 1 a double-ended bit is mounted on the shaft. At the base of the shaft, the latter is provided with a truncation 13 which makes it possible to work with the bit holder shaft not only in its fully extended 180° operating position but also, if desired in exceptional cases, at a 90° angle. This additional setting can be used for other tool bits as well.

FIG. 1 also shows the bit cartridge 2 which, when pressure is applied on the protective nosepiece 3, can be tilted out around the spindle 4. This requires that the bit holder shaft 1 be tilted open as well. In the design example shown, the cartridge contains 3 additional double-ended bits. Besides pressing down on the protective nosepiece 3, pressure may also be applied on surface point 16 for tilting out the cartridge.

The sectional illustrations in FIGS. 2 to 4 show details of the overall system such as the positioning of the bit cartridge between the jackplates 5, the two hexagonal sockets 14 and 15 on the bit holder shaft 1, and the use of section 7 extending along the plane of the jackplates 5 as bit retaining ridges on the bit cartridge. The bit cartridge may be made, for example, out of thermoplastic or metal and is provided with receptacles for single- or double-ended bits which may be held in the cartridge and, respectively, in the socket head 15 of the bit holder shaft by means of spring-loaded balls. After the bit holder shaft has been tilted out, the bit cartridge can be tilted out as needed for withdrawing the desired bit and mounting it in the bit holder. The jackplates 5, specially designed for this purpose, are shown in detail in FIG. 6. This jackplate is provided with a large cutout which, as shown in FIG. 3, is needed to accommodate the additional width of the bit cartridge created by the retaining ridge 7 within the plane of the jackplate. Thus, the bit cartridge occupies space between the intermediate plates as well as space out of the jackplate itself.

Figure 7:
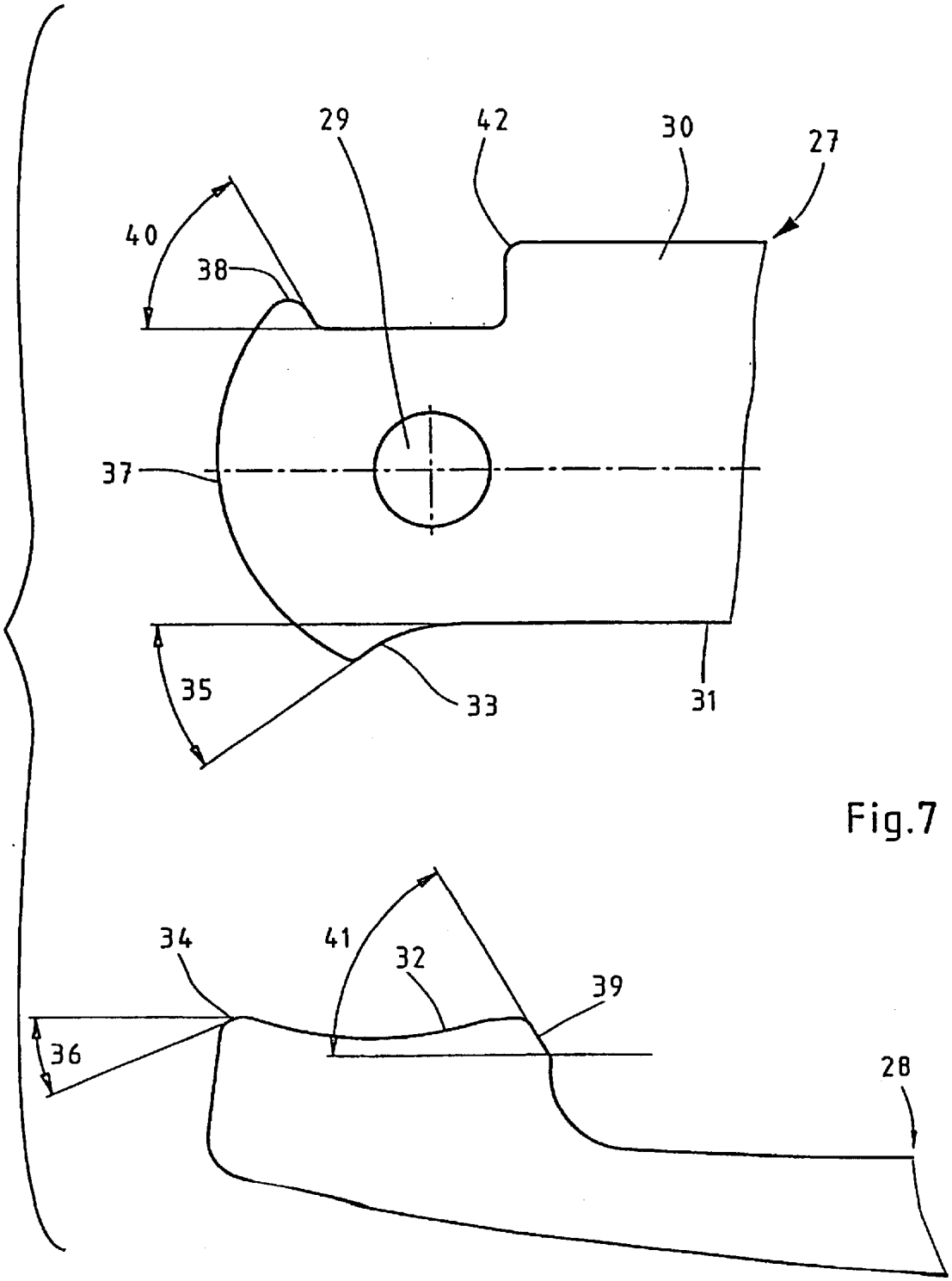
FIG. 7 is a detailed illustration of a matched cam/cam-disk combination.

FIG. 7 illustrates the special feature which controls and improves the positional locking strength for extensible operational elements. In FIG. 7, the base section 30 of such an operational element 27 is pivot-mounted to swivel around the axis 29; 28 is the corresponding end section of the spring. In its passive carrying position (retracted position) the retracted position stop cam 31 of the operational element 27 rests on the retracted-stop section 32 of the spring 28. In the design example shown, a retracted position cam 33 of the base section 30 is engaged with a first detent 34 on the spring. The locking strength in the passive carrying i.e., retracted position of the operational element is thus a function of the size of the retracted position cam 33 and of the strength of the spring. The angle 35, for instance between 22° and 37°, determines the amount of force required to lift the retracted position cam 33 away from first detent 34. The angle 36 of the cam recess 34 must be within a corresponding range between 20° and 35°. When the operational element is grasped and forcibly tilted out against the strength of the spring action, lifting the retracted position cam 33 away from first detent 34, the line of movement 37 at the extreme end of the base section will extend through the retracted-stop section 32. This laterally guided travel assures a proper tilt-out movement of the operational element 27 relative to the spring 28. The tilted-out position cam 38 at the base in the design version illustrated will finally engage a second detent 39 at the other edge of the spring. The height of the stop 42 defines the tilt-out position. For this paired combination of cam and detent as well, the angle 40 of the tilted-out position cam 38 of the base section 30 and the angle 41 of the second detent 39 on the spring 28 are suitably matched, both being for instance 60°. This produces a corresponding locking strength of the operational element 27 in its extended i.e., tilted-out position, which virtually prevents any accidental retraction during its use.

The design versions described serve as explanatory, non-limiting examples only. In particular it is possible to provide at the end of the base section only one retaining cam for the purpose of increasing the locking strength in one of the end positions. Also, the cams may be on the spring and the recesses on the base section. Suitable alternative guide disks operating in similar fashion may also be considered.

What is claimed is:

1. A pocket tool comprising:

a handle having a longitudinal axis, and a first side and a second side extending along side handle longitudinal axis;

a bit holder pivotably coupled to said handle; and a bit cartridge pivotably couple to said handle; wherein:

said bit holder includes a shaft with a longitudinal axis, a first end formed as a bit-holding tip, and a second end having a swivel-mounting section mounted on a spindle, wherein said shaft longitudinal axis is offset form said spindle;

a tool chamber is defined in said first side of said handle;

said bit holder and said bit cartridge are pivotable between a retracted position in said tool chamber and a tilted-out position said tool chamber; and both said bit holder and said bit cartridge are accessible from said first side.

2. A pocket tool as in claim 1, wherein said bit holder shaft longitudinal axis is offset to permit said bit cartridge to be stored in said tool chamber below said bit holder.

3. A pocket tool as in claim 2, wherein said bit cartridge is accessible only when said bit holder is in said tilted-out position.

4. A pocket tool as in claim 1, wherein said bit holding tip includes at least two hexagonal sockets of different widths, one axially positioned behind the other.

5. A pocket tool as in claim 4, further comprising a spring element, wherein said swivel-mounting section of said bit holder shaft bears on said spring element.

6. A pocket tool as in claim 5, wherein said spring element extends over only a partial length of said handle.

7. A pocket tool as in claim 6, wherein between said swivel-mounting section of said bit holder and said spring element, impact and pressure surfaces extend at an oblique angle relative to said handle longitudinal axis.

8. A pocket tool as in claim 7, wherein:

said spring element further comprises detents; and said detents and said swivel-mounting section of said bit holder are in the form of matched surfaces which interact to lock said bit holder in a desired position.

9. A pocket tool as in claim 8, wherein said tool chamber is formed from intermediate plates.

10. A pocket tool comprising:

a handle having a first end, a second end, a first side, a second side and a central longitudinal axis equidistant from said first and second sides;

a tool chamber formed within handle;

a swivel-mounting section pivotably coupled to said handle first end about a spindle spaced from both said first side and said second side of said handle and closer to said handle center longitudinal axis than to either of said first and second sides;

a bit holder coupled to said swivel-mounting section and having a longitudinal axis; and a bit cartridge pivotably coupled to said handle second end; wherein:

said bit holder is coupled to said swivel-mounting section such that said bit holder longitudinal axis is offset from said spindle;

said bit holder is offset from said handle central longitudinal axis when in a retracted position such that said tool chamber is enclosed by said bit holder;

said bit cartridge is stored below said bit holder within said tool chamber;

said bit holder must be extended before said bit cartridge is accessible to be extended; and said bit holder and said bit cartridge are accessible only from said first side of said handle.

11. The pocket tool of claim 10, further comprising a spring element having a first end coupled to said handle and a second end engaging said swivel-mounting section.

12. The pocket tool of claim 11, further comprising a plurality of additional operational elements pivotably coupled to said handle.

13. The pocket tool of claim 10, wherein said bit cartridge is shaped to hold a plurality of bits in parallel, non-collinear orientations such that said bits are independently accessible in said bit cartridge.

14. The pocket tool of claim 10, further comprising:

an operational element having a base section pivotably coupled to said handle for movement of said operational element between a retracted position within said tool chamber and a tilted-out position outside said tool chamber; and a spring element with a first end coupled to said handle, a second end engaging said base section of said operational element, and a free end at said second end; wherein:

said operational element base section includes a tilted-out position cam;

said second end of said spring element includes a detent spaced from said spring clement free end; and in said tilted-out position of said operational element, said tilted-out position cam engages said detent to inhibit said operational element from returning to said tool chamber.

15. The pocket tool of claim 14, wherein in said retracted position of said operational element, said second end of said spring element engages said base section to maintain said operational element in said retracted position.

16. A pocket tool comprising:

a handle having a first end, a second end, a longitudinal axis extending between said first and second ends, a first open side extending along said handle longitudinal axis and between said first and second sides, and a second open side extending along said handle longitudinal axis and between said first and second sides;

at least one jackplate separating said handle into at least one tool chamber; and a bit cartridge pivotably coupled to one of said first and second ends of said handle for pivotable movement between a retracted position in said tool chamber and a tilted-out position outside said tool chamber; wherein:

at least one retaining ridge is formed on said bit cartridge facing said jackplate;

a cutout is formed in said at least one jackplate; and said bit cartridge retaining ridge engages said jackplate cutout to prevent said bit cartridge from extending out of said handle through said second open side of said handle.

17. A pocket tool as in claim 16, wherein said retaining ridge is accommodated within the plane of said jackplate.

18. A pocket tool as in claim 16, wherein:

said jackplate includes a first side adjacent said first open side of said handle and a second side adjacent said second open side of said handle; and said bit cartridge has a longitudinal axis, a first side defining receptacles for bits, and a second side adjacent and accessible through said second open side of said handle when said bit cartridge is in said retracted position.

19. A pocket tool as in claim 18, wherein said second side of said bit cartridge is aligned with said second side of said jackplate when said bit cartridge is in said retracted position.

20. A pocket tool as in claim 18, wherein said receptacles are oriented transverse to said bit cartridge longitudinal axis.

21. A pocket tool as in claim 16, wherein said bit cartridge has a nosepiece adjacent said one of said first and second ends of said handle and shaped such that upon application of pressure thereto said bit cartridge is tilted out of said retracted position and into said tilted-out position.

22. The pocket tool of claim 12, further comprising:

an operational element coupled to said swivel-mounting section and having a longitudinal axis; and a spring coupled to said handle and having a locking spring end engaging said swivel-mounting section; wherein:

said operational element is pivotable between a retracted position within said tool chamber and a tilted-out position outside said tool chamber; and said swivel-mounting section is in the form of a circular segment with a plurality of cutouts forming cams for locking functions in conjunction with said spring.

23. The pocket tool of claim 22, wherein:

said handle first end is rounded; and said circular segment is dimensioned to conform to the rounded shape of said handle first end such said circular segment does not extend beyond said handle first end during pivoting of said bit holder between said retracted position and said tilted-out position.

24. The pocket tool of claim 22, wherein said spring has a longitudinal axis, a first end coupled to said handle, and a second end with a protrusion extending transverse to said longitudinal axis and shaped to engage within a cutout of said swivel-mounting section to lock said operational element in a desired position.

25. The pocket tool of claim 14, wherein:

said operational element includes a shaft with a shaft base coupled to said base section;

a recess is defined in said base section between said shaft base and said tilted-out position cam; and said free end of said spring element abuts said shaft base to prevent further tilting of said operational element out of said storage compartment.

26. The pocket tool of claim 25, wherein said second end of said spring element includes a protrusion shaped to extend into said recess in said base section of said operational element between said shaft base and said tilted-out position cam.

* * * * *